United States Patent [19]

Jones

[11] 4,167,815

[45] Sep. 18, 1979

[54] DEVICE FOR PRE-RULING PRINTING FORMS

[76] Inventor: Raymond L. Jones, 6125 Manning, Raytown, Mo. 64133

[21] Appl. No.: 933,666

[22] Filed: Aug. 14, 1978

[51] Int. Cl.[2] ..... B43L 13/24

[52] U.S. Cl. ..... 33/430; 33/450

[58] Field of Search ..... 33/80, 76, 81, 32 R, 33/32 B, 1 G, 1 K, 1 AA, 40, 108, 110, 184.5

[56] References Cited

U.S. PATENT DOCUMENTS

| | | | |
|---|---|---|---|
| 408,387 | 8/1889 | Ortell et al. | 33/81 X |
| 3,287,809 | 11/1966 | Vogel | 33/81 |
| 4,038,751 | 8/1977 | Albright | 33/76 X |

*Primary Examiner*—Harry N. Haroian
*Attorney, Agent, or Firm*—Thomas M. Scofield

[57] ABSTRACT

Improvements in devices for measuring, laying out and ruling keyline boards for printed materials; a device for pre-ruling artists' and printing boards including a baseboard adapted to receive a keyline board thereon having precisely positioned location pins surrounding the work area and a slotted ruler for use with the baseboard, such producing page size and crop mark lines, bleeds, automatic register mark rules and all horizontal and vertical ruling required for 11 by 17 inch, 8½ by 11 inch and 5½ by 8½ inch formats.

9 Claims, 12 Drawing Figures

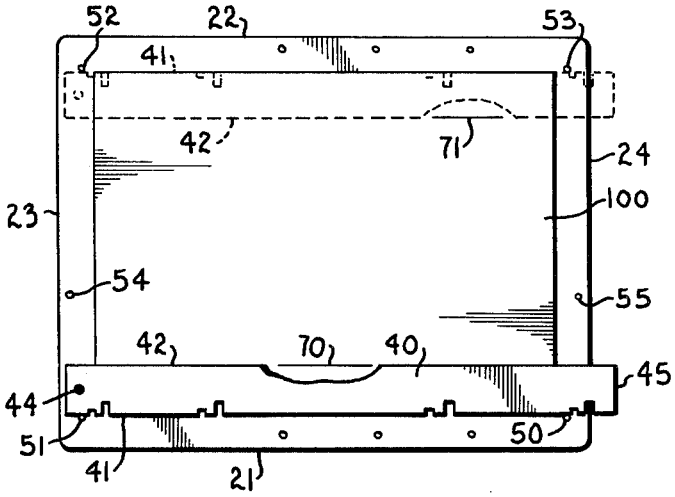
Fig. 4.
Fig. 5.
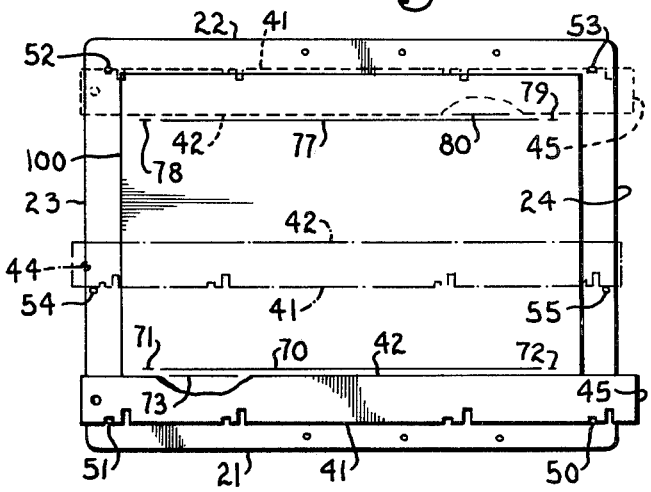
Fig. 6.
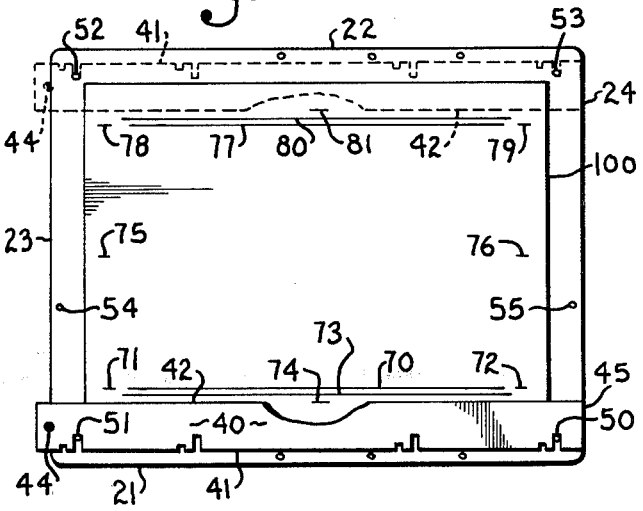
Fig. 10.
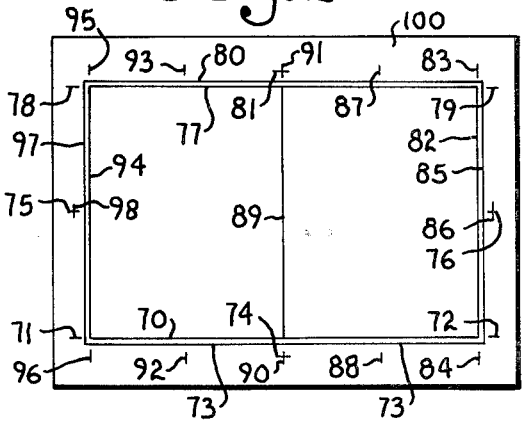

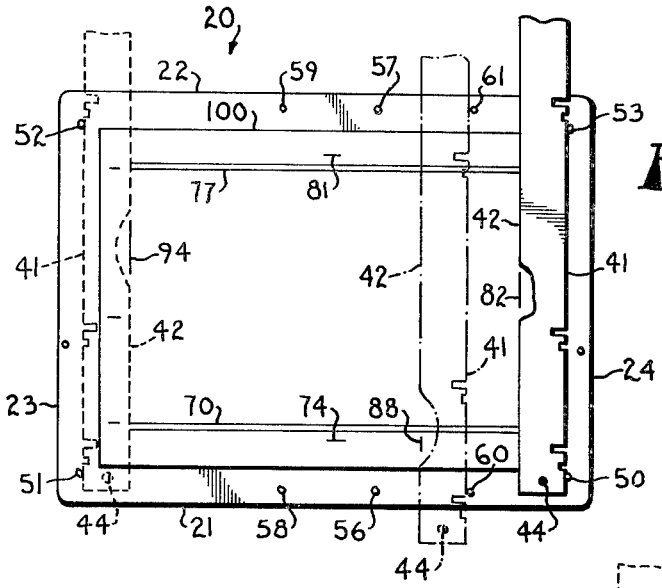
Fig. 7.
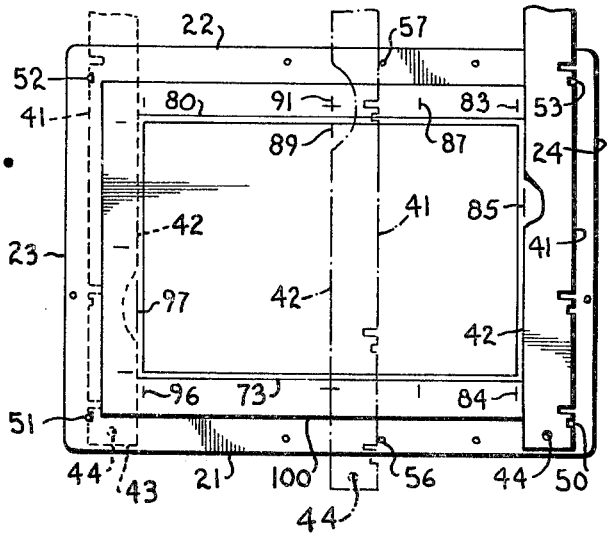
Fig. 8.
Fig. 9.
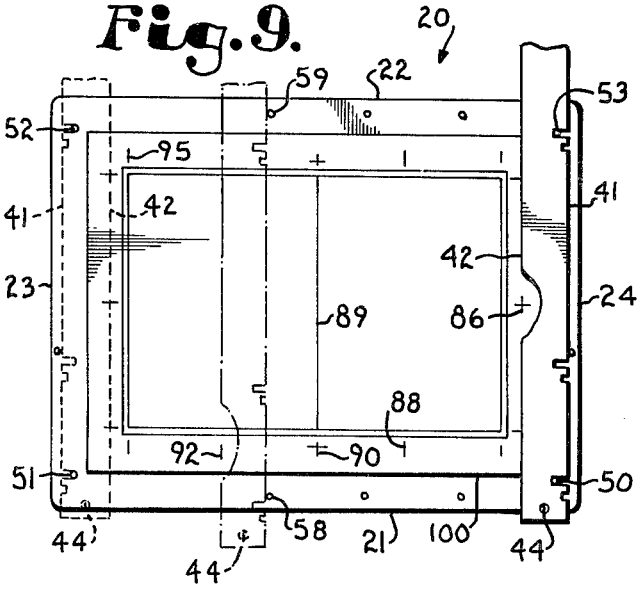
Fig. 11.
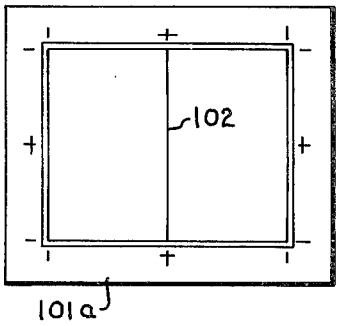

DEVICE FOR PRE-RULING PRINTING FORMS

BACKGROUND OF THE INVENTION

This invention relates to methods of and apparatus for the pre-ruling of keyline boards for artistic or printed material.

The standard sizes for art work or printing work are three in number. Thus 11 by 17 inches corresponds to a standard open book and printer's flats. Leaflets, brochures and other books may employ, alternatively, 8½ by 11 inch spaces or 5½ by 8½ inch spaces. These three sizes rule, as commercial artists' work must be printed and printing presses are standardized.

Therefore, prior to a commercial artist beginning his paste-up or finished art work, he conventionally must put the art or keyline board on his artist's table and, typically, with a T-square and ruler, rule out the spaces and work areas on the art form or keyline form with which he is going to deal. These typically involve the following zones or marks:

(1) A first, continuous, interior line on the work defining the work area of one of the three size areas mentioned above;

(2) Typically, a ⅛ inch bleed (waste material cutoff) which is provided outside of the previously mentioned work area defining line or set of lines;

(3) Outside of the latter, register marks for the printer are provided so that the printer can align the work for reproduction;

(4) Horizontal and vertical crop mark measurements of trim lines or marks; and (5) The center fold indication or mark.

Measuring, laying out and ruling keyline boards for printed material by conventional methods using conventional tools is a time consuming task. Each time the artist measures with a ruler, lines up his T-square to a pencil line or holds a T-square and triangle in one hand while ruling, there is a chance of error.

Because of time considerations and the many problems of accurate ruling of the necessary noted elements with respect to art and keyline boards of different size, it is desirable to have a universal board which may be employed to handle all of the noted conventional size art and keyline boards to rule the desired elements noted thereon in the swiftest and easiest possible way.

OBJECTS OF THE INVENTION

A first object of the subject invention is to provide a board and ruler construction which, used in combination, permit swift, accurate and complete pre-ruling of keyline and art forms or boards of the most frequently used conventional sizes.

Another object of the subject invention is to provide such a board and ruler construction which, in combination, cooperate to permit ruling on art and keyline boards and forms of the noted conventional sizes the following listed zones or marks:

(1) The desired margins for the work area;

(2) The desired bleed zone for waste material cut-off;

(3) Register marks for the printer;

(4) Trim or crop marks; and (5) Fold indications or marks.

Another object of the invention is to provide such cooperating board and ruler constructions for ruling keyline and art forms and boards as described which will receive and rule:

(1) 14 and 15 by 20 inch boards to give 11 by 17 inch margin space;

(2) 11 by 14 inch boards to give 8½ by 11 inch margin space; and (3) Further, halve precisely each such 11 by 17 or 8½ by 11 inch margin spaces, if desired (and quarter the former if desired).

Another object of the invention is to provide such board and ruler constructions for pre-ruling keyline and art forms and boards which are of simple, rugged construction, each (and the both together) having a long life under hard continuous use.

Yet another object of the invention is to provide such board and ruler constructions which are easy, accurate, swift and simple to use and, further, may be produced or manufactured for minimum cost. Further, all measurements are automatic, with no ruler measurements required.

Other and further objects of the invention will appear in the course of the following description thereof.

DESCRIPTION OF THE DRAWINGS

In the drawings, which form a part of the instant specification and are to be read in conjunction therewith, an embodiment of the invention is shown and, in the various views, like numerals are employed to indicate like parts.

FIGS. 4–6 incl. show positions that the ruler assumes in horizontal orientation on the board ruling the various lines required for pre-ruling of art and keyline boards and forms. In each of the views, portions of the ruler are cut away to show the rulings being made at the particular position. The art board shown is 15 by 20 inches on which is to be ruled the desired and necessary lines and marks for an 11 by 17 inch layout.

FIG. 4 shows the subject baseboard having a 15 by 20 art form or board mounted thereon with the ruler shown in the positions to mark the bottom and top page size and crop mark rulings for the 11 by 17 inch lay out. The ruler is shown in full lines below and dotted lines above.

FIG. 5 is a view like FIG. 4 but with the ruler in its upper and lower positions engaged with the board corner pins to rule the upper and lower horizontal bleed lines. The center showing of the ruler permits ruling the two horizontal register marks (or ruling the center horizontal line through an 8½ by 11 sheet to lay out 5½ by 8½ formats).

FIG. 6 shows the ruler in upper and lower positions (full lines lower and dotted lines upper as in the previous drawings) in order to rule the upper and lower register marks.

The showings of the previous FIGS. 4–6 incl. illustrate all of the horizontal lining done in the process of preruling art and keyline boards and forms, but, while the order described can be followed as set forth, it need not be.

FIGS. 7–9, inclusive show the particular positions assumed by the ruler with respect to the board of FIGS. 4–6, inclusive in order to rule the various vertical marks and lines desired or required with respect to the 11 by 17 inch layout. In each of the views, one showing of the ruler is in full lines and the other showings in dotted lines. Additionally, portions of the ruler are cut away to show the particular marking or line being ruled for the ruler position shown.

FIG. 7 is a plan view of the board as FIGS. 4–6, inclusive with the ruler in vertical position at the right and left sides of the board positioned to rule the right and left hand page lines and right and left hand crop marks. The dotted line ruler showing at the right center is to rule the right hand page center marks.

FIG. 8 is a view like that of FIG. 7, but with the right and left hand vertical ruler showing positioned for lining of the bleed lines vertically on the 11 by 17 layout. The near center dotted line ruler showing is to rule the register marks and the center page line.

FIG. 9 is a view like FIGS. 7 and 8 with the right and left hand ruler showings positioned to rule the right and left hand ruler showings positioned to rule the right and left hand register marks. The left center dotted line showing of the vertical ruler is to rule the left hand page center marks.

Once again, the showings of the previous figures illustrate all the vertical lining done in the process of pre-ruling art and keyline boards and forms, but, while the order described can be followed, it need not be.

FIG. 10 is a plan view of an 11 by 17 format completely ruled on a 17 by 20 inch art form board.

FIG. 11 is a plan view of an 8½ by 11 format completely ruled, this having been transformed to an 8½ by 5½ format by ruling vertically through the center of the 8½ by 11 inch format. The board itself is 11 by 14 inches.

Figure 12:
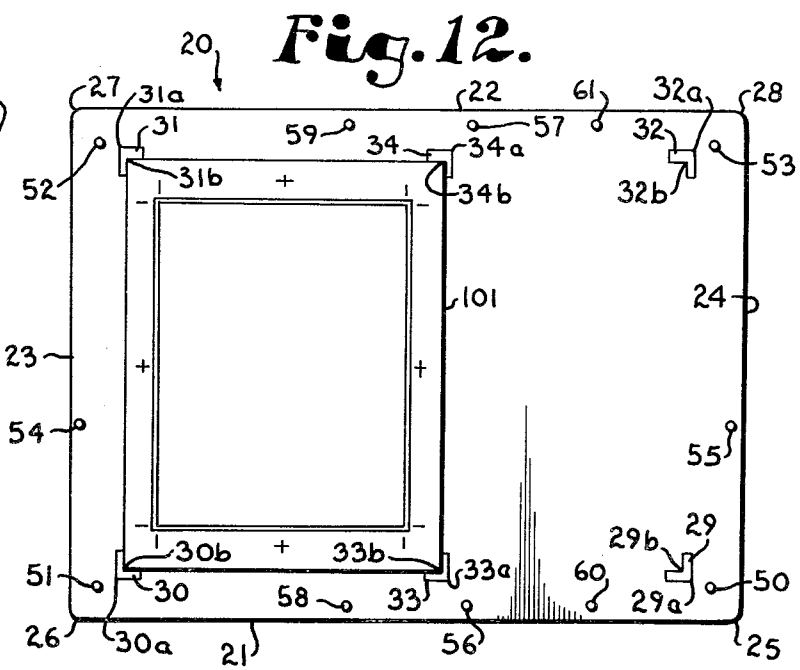
Figure 1:
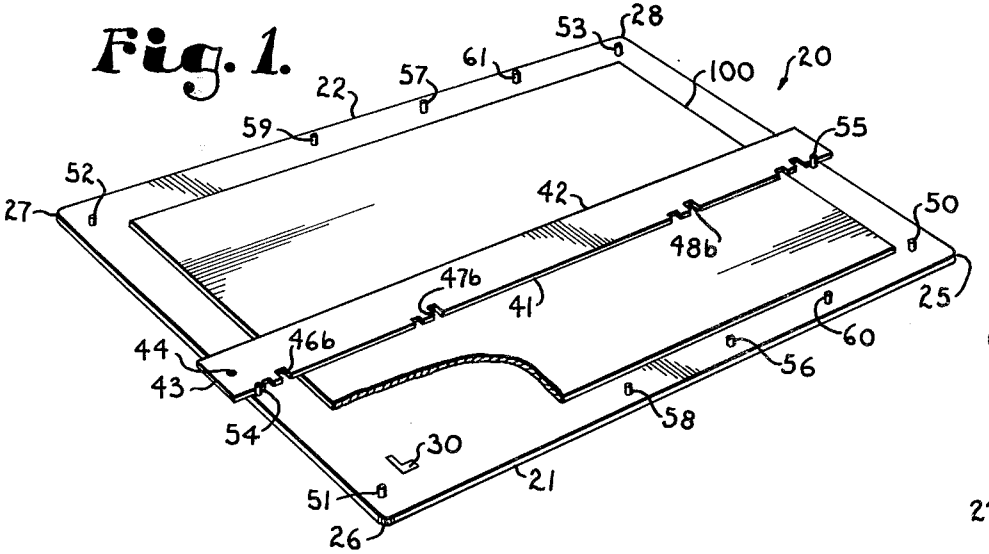
FIG. 1 is a three-quarter perspective view from above of the subject board and ruler construction for pre-ruling art and keyline boards and forms the subject baseboard shown with a 15 by 20 inch art form or board mounted thereon (a portion of the latter cut away in the lower left hand corner to show one of the aligning marks for the 15 by 20 inch art form board), the ruler overlying the art form board prior to beginning the ruling process.
Figure 3:
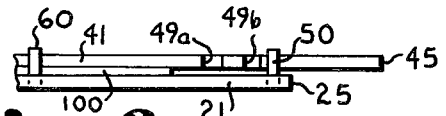
FIG. 3 is a fragmentary view of the lower right hand corner of the subject board with the ruler thereon and an art form board on the baseboard, the ruler shown abutting one corner pin on the baseboard adjacent one end of the ruler.
Figure 2:
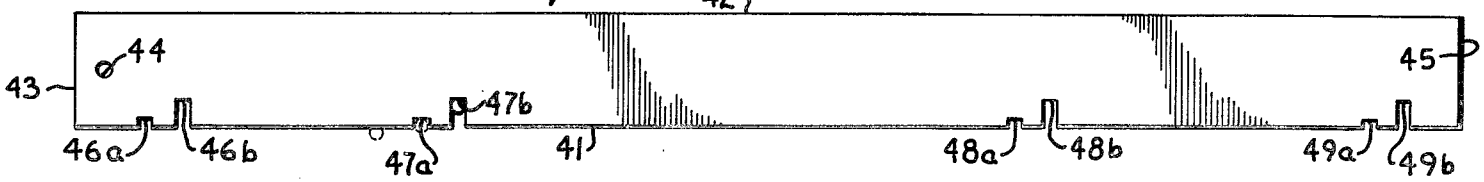
FIG. 2 is an enlarged plan view of the ruler construction (enlarged with respect to the showing in FIG. 1 and subsequent figures) with the three operative pin positions shown with respect to one set of the slots in the ruler.

FIG. 12 is a plan view of the baseboard of the previous described figures with the art form or board mounted thereon completely ruled for an 8½ by 11 format, same located thereon by the board markings. The art form board is 11 by 14 inch size.

STRUCTURE & FUNCTION

There is first provided a flat, rectangular baseboard generally designated 20 having (with respect to the user or operator) a lower edge 21, an upper edge 22, a left side edge 23 and a right side edge 24. As seen in the drawings, which are presented from the view or viewpoint of a user or operator, the upper and lower edges 22 and 21, respectively, are normally horizontal, while the left and right side edges 23 and 24, respectively, are normally vertical. Precise dimensions will be later given, but to give an idea of scale, the board or baseboard 20 has a horizontal length typically greater than 20 inches and a vertical height or depth greater than 15 inches. Starting with the lower right hand corner, the corners of the baseboard are numbered 25–28, inclusive, going in a clockwise direction from the lower right hand corner.

The working face of the baseboard 20 has location indicia marked thereon for placing artist's and printing boards of certain sizes in alignment on that surface for keyline marking and, as well, a plurality of location pins fixed to the baseboard working face around the periphery thereof and extending at right angles thereto. Four precisely spaced location indicia 29, 30, 31 and 32, respectively, are positioned adjacent the corners 25–28, inclusive, again working clockwise from the lower right hand corner of the baseboard. Each such indicia is made up, at least, of an outboard right angle vertex *29a, 30a*, etc. comprising two lines oriented at right angles to one another, parallel to the edges of the board and meeting in a point vertex. The four point vertexes *29a* through *32a* and the associated lines defining the vertexes serve to locate larger artist or printing boards typically of a size 20 inches long by 15 inches high or wide. An inboard or internal vertex is provided at each location indicia, again, in each case being defined by a pair of lines parallel to the side edges of the board meeting at vertices *29b–32b*, inclusive. These vertices *29b–32b*, inclusive are so sized and oriented as to define the positioning of illustration boards 20 inches long and 14 inches wide or high.

Positioned more centrally of baseboard 20, but adjacent the upper and lower edges are location indicia generally designated 33 (lower) and 34 (upper) indicia 33 and 34 cooperate with indicia 30 and 31 to locate 11 by 14 illustration boards within them. The interior or inboard vertices *33b* and *34b* are used for this purpose in connection with inboard or interior vertices *30b* and *31b*. Indicia 33 and 34, for symmetry of design, also typically have outboard vertices *33a* and *34a* opposable with and symmetrical to outboard vertices *30a* and *31a* of indicia 30 and 31, respectively.

Turning to the location pins, the basic function of the location pins is to permit the placement of the ruler (to be described) thereagainst, in various positions, to rule on the work or illustration board the desired lines and markings. Because the artist, operator or user of the board is working with an illustration board of a precise size (15 by 20 inches or 14 by 20 inches or 11 by 14 inches) the indicia marks previously described must outline the precise position on the baseboard where each of such illustration boards is to be fixed by removable masking tape or the like. The lines and markings to be ruled on each of the particular size boards mentioned are to be ruled and marked on the said boards with a ruler (to be described) of sufficient length, but also a fixed width. This means that, for a fixed position of a given size illustration board on the baseboard (as defined by the location indicia previously described) and using a ruler of a certain width, the ruler locating pins should be precisely and symmetrically spaced with respect to the periphery of the baseboard, as well as the illustration board locating indicia thereon. The number and placements of the required location pins will be described, after the description of the ruler.

The ruler is generally designated 40 and has a first longitudinal edge 41 with sets of notches therein to be described. The opposite longitudinal edge of the ruler is designated 42. With edge 41 toward the observer in the views, the left edge of the ruler is designated 43 and has a suspension or hangup hole 44 therein. The other end or edge of the ruler is designated 45. Beginning from the left edge of ruler 40, at edge 43, there are four sets of notches in longitudinal edge 41 of ruler 40, specifically notches 46*a* and b through 49*a* and b moving from left to right on the ruler.

With respect to dimensions of this specific ruler, the length is preferably 24 inches and width 1.995 inches. Optimally the ruler may be made of aluminum having a material thickness of 0.063 inches. The depth of notches 46*a* through 49*a* is preferably 0.125 inches and the depth of notches 46*b* through 49*b* is preferably 0.500 inches. Using edge 45 as a base line datum for measurements, the distance from edge 45 to the respective centers of slots or notches 49*b* through 46*b* are 1.019 inches, 7.019 inches, 17.519 inches and 22.231 inches. The distance between centers of adjacent slots or notches of a set (for example notches 49*a* and 49*b*) is 0.562 inches.

Four of the said location pins 50–53, inclusive are located one closely positioned adjacent each corner of the baseboard in a rectangular array. As will be described, pins 50–53, inclusive (clockwise designated from the lower right hand corner of the board) are for use in connection with the said ruler at least for drawing the work area margin lines, the bleed area lines and register marks for an 11 by 17 inch size work area on an artist or printing board.

As previously stated, the length (or width from left edge 23 to right edge 24) of baseboard 20 is preferably 23.250 inches and the height, preferably, 17.750 inches. The board may be of aluminum having a material thickness of 0.090 inches with pin height above the board of approximately $\frac{5}{8}$ of an inch. The pin diameter in the subject board specifically described may be 0.212 inches. The width of ruler slots or notches 46*a*–49*a*, inclusive and 46*b*–49*b*, inclusive is preferably slightly greater than 0.212 inches.

Using edge 24 as a base datum, the distance therefrom to the centers of pins 50 and 53 is preferably 1.019 inches. Using the same base datum, the distance to the centers of pins 51 and 52 is preferably 22.231 inches. Using edge 21 as a baseboard datum, the distance therefrom to the centers of pins 50 and 51 is preferably 1.269 inches. The distance from base line 21 to the centers of pins 52 and 53 is preferably 16.481 inches.

Referring, then, to the lower right and left centers of board 20, adjacent edges 23 and 24 and intermediate the corner pins 51 and 52 and 50 and 53, respectively, there are positioned location pins 54 and 55. The purposes of these pins, as will be described, include ruling the horizontal register marks, horizontally halving work areas of 11 by 17 inch size and vertically halving $8\frac{1}{2}$ by $5\frac{1}{2}$ inch formats. Using lower edge 21 of baseboard 20 as a datum line, the vertical distance to the centers of pins 54 and 55 therefrom is preferably 6.769 inches. Using right edge 24 as a base line datum, the distance therefrom to the center of pin 55 is preferably 0.390 inches and to the center of pin 54 22.860 inches.

In order to perform the ruling functions to be described in detail, not only are there required the four corner location pins 50–53, inclusive, there are also required four additional sets or pairs of outer locating pins (outboard with respect to the corner locating pins), in the process of being described. Pins 54 and 55 are the first pair of said outer locating pins.

The second pair of outer locating pins comprises lower pin 456 and upper pin 57 located somewhat to right of center of baseboard 20 and closely adjacent edges 21 and 22, respectively. These pins permit the vertical halving of 11 by 17 inch work areas, as well as ruling vertical center register marks therefor. They additionally, as will be described, permit the ruling of right hand side area, bleed and register marks in an $8\frac{1}{2}$ by 11 format as well as the same for one long side of an $8\frac{1}{2}$ by $5\frac{1}{2}$ inch format. Pins 56 and 57 are 9.519 inches from edge 24.

The third set or pair of outer location pins are numbered 58 and 59, respectively, positioned closely adjacent edges 21 and 22, respectively. These pins serve at least for providing 11 by 17 inch work area page center mark measurements for the left hand page of 11 by 17 work areas. Using edge 24 as a base line, pins 58 and 59 have their centers preferably 13.769 inches therefrom. Using edge 21 as a base line, the distance of the center of pin 58 therefrom (as is the case in the center of pin 56) is 0.625 inches. From edge 21 to the center of pin 59, as is the case with the center of pin 57, comprises 17.125 inches. Pins 58 and 59 are to the left of center.

The fourth pair of outer pins are numbered 60 and 61, positioned adjacent edges 21 and 22, respectively, and also positioned spaced from base line 21 the same distance as pins 56 and 58 and 57 and 59, respectively. From base line 24, the distance to the centers of pins 60 and 61 comprises 5.269 inches. The purpose of these pins is at least for providing the page center mark measurements for the right hand page of an 11 by 17 inch work area.

From the foregoing description, it may be seen that a baseboard 20 has been provided with illustration board indicia location thereon, as well as corner location pins and four sets or pairs of outer pins thereon. These pins, for the size of the illustration board and location of the location indices or indicia vertices have the pin placements, for pins of a given diameter, as given. Such also take into account a ruler of a width as previously given.

Referring back to the ruler, the outermost two sets of slots on the ruler, specifically, slots or notches 46 and slots or notches 49, are so spaced as to be able to simultaneously engage the two upper (52 and 53) or lower (51 and 50) horizontal corner pins in like depth slots, when the ruler is positioned in horizontal orientation. Further, at least one of the adjacent sets of slots (or pairs of slots) on the ruler, with one of said adjacent sets being an end set on the ruler, is so spaced as to be able to simultaneously engage the right (50 and 53) or left (51 and 52) vertical corner pins in like depth slots. Adjacent in such context means sets of slots or sets of pairs of slots which are not both end slots or end pairs of slots. Said otherwise, slots 46 and 48 or slots 49 and 47, or both of them, are so spaced from one another as to be able to simultaneously engage the two right or left vertical corner pins in like depth slots.

OPERATION

The procedure for keylining an 11 by 17 format will first be described, then the $8\frac{1}{2}$ by 11 format and, thereafter, the $5\frac{1}{2}$ by $8\frac{1}{2}$ inch format. With respect to these formats, the following are provided: Page size rulings, bleed mark rulings, horizontal and vertical crop mark rulings, horizontal and vertical registration mark rulings, work area center measurement and page center mark rulings. The production of these rulings in the most orderly fashion will now be described and are shown in the figures.

If a 15 by 20 inch illustration board is to be employed, it is located by vertices 29*a*–32*a*, inclusive and fixed with respect thereto by masking tape or the like. If a 14 by 20 inch illustration board is to be used, its corners are located by vertices 29*b*–32*b*, inclusive and, again, the board is fixed to the baseboard surface by masking tape or the like.

Ruler 40 is then placed horizontally, parallel to lower edge 21 in contact with corner pins 50 and 51 on edge 41 without any of the notches or slots 46–49, inclusive engaging the pins. The bottom page size line 70 may then be ruled, as well as the horizontal left and right crop marks 71 and 72. Thereafter, the ⅛ inch deep slots or notches **46*a* and 49*a* are engaged on pins 50 and 51 and bleed mark ruling 73 may be made. Thereafter, ½ inch deep slots 46*a* and 49*b* are engaged on pins 50 and 51, whereby two permit the ruling of the horizontal portion 74 of the lower center register mark. These operations are seen in the full line showings of the lower parts of FIGS. 4–6**, inclusive, successively.

Ruler 40, with the slotted or notched edge still down, is then lifted and placed with its edge 41 against the upper surfaces of pins 54 and 55. The horizontal lines 75 and 76 of the side edge register marks may then be ruled. This position, incidentally, is also used when ruling the center horizontal line through an 8½ by 11 inch format to layout 5½ by 8½ inch formats. This is seen in FIG. 5 horizontal center.

At this point, ruler 40 is preferably turned over, keeping the suspension or hangup hole 44 to the user's left so that the notched or slotted edge 41 faces upwardly. This edge is then placed against upper corner pins 52 and 53 successively in three positions to rule upper page size line 77, upper horizontal crop marks 78 and 79, upper bleed line 80 and upper center horizontal register line 81. Line 81 is ruled with slots **46*b* and 49*b* fully engaging pins 52 and 53. Bleed lines 80 is ruled with slots 46*a* and 49*a* engaging the same pins. The other lines are ruled on the nonslotted portion of edge 41. Such action is seen in the top portions of FIGS. 4–6** inclusive in dotted line ruler showing.

Ruler 40 is then placed vertically on the board, preferably with hangup hole 44 downwardly and moved to the right side of baseboard 20 to successively engage corner pins 50 and 53 in the three previously described manners: first, on the nonslotted portion of edge 41 to rule the right hand page line 82 and crop marks 83 and 84; secondly, with pins 50 and 53 engaging shallow slots **46*a* and 48*a* to rule bleed line 85 and, finally, with slots 46*b* and 48*b* engaging pins 50 and 53, to rule the vertical register line 86 intersecting horizontal register line 76. The three full line ruler showings on the right hand sides of FIGS. 7–9** inclusive show these operations.

Ruler 40 is then moved to the left of pins 60 and 61, engaging them with the nonslotted portions of edge 41 to permit the ruling of righthand page center lines 87 and 88. See FIG. 7 right of center dotted line ruler showing.

Ruler 40 is then moved, in vertical orientation, to the left of pins 56 and 57. Engaging them, FIG. 8, with the nonslotted edge portions thereof, center page line 89 and vertical register mark lines 90 and 91 may be ruled.

Following the latter markings, ruler 40, in vertical position, is moved to the left of pins 58 and 59 where, engaging them with the nonslotted edge 41, the left hand page center lines 92 and 93 may be ruled. This is seen in the left center of FIG. 9.

At this point, ruler 40 is preferably turned over, keeping hangup hole 44 down toward the operator and moved left in vertical position whereby to engage corner pins 51 and 52. Corner pins 51 and 52 are, then, engaged by edge 41 of ruler 40 successively in three positions to accomplish three sets of rulings. With the nonslotted edge 41 portion engaging pins 51 and 52, the left hand page size line 94 and vertical crop marks 95 and 96 may be ruled. With pins 51 and 52 engaged in shallow slots **46*a* and 48*a*, bleed line 97 may be ruled. Finally, with pins 51 and 52 engaged by deeper slots 46*b* and 48*b*, the vertical register line 98 intersecting horizontal register line 75 may be ruled. FIGS. 7–9** inclusive to the left in each view, show these operations.

At this point, as previously described, the entire array of elements previously listed have been ruled. The board 100 of FIG. 10 is shown completely ruled as described.

In order to rule an 8½ by 11 inch format, an 11 inch by 14 inch board is used. This is located by vertices **30*b* and 31*b* on the left of indicia marks 30 and 31 and vertices 33*b* and 34*b* of indicia marks 34 on the right center. Such an arrangement is seen in FIG. 12 with board 101** placed as noted.

Without repeating the entire sequence of description of ruling of the various lines and marks seen on board 101, it is first noted that ruler 40 rules the horizontal lines and marks on board 101 from pins 50 and 51 (lower lines and marks) pins 54 and 55 (center marks) and pins 52 and 53 (upper lines and marks) in the same manner as seen in FIGS. 4–6 incl. With respect to the vertical lines and marks on board 101, as seen in FIG. 12, the sequence of operations is the same as in FIGS. 7–9 incl., but the right hand side vertical lines and marks are made starting from pins 56 and 57, with the center vertical marks made from pins 58 and 59.

In ruling the former (right hand side verticals from pins 56 and 57), the ruler 40 is inverted, with end 45 downward, so slots 47 and 49 may be used to engage pins 56 and 57. This is the only time slots 47 are employed. All the other verticals are made with the ruler seen in the orientation of FIGS. 7–9, inclusive.

To produce the 5½ by 8½ inch format of board **101*a* in FIG. 11 it is required only, after ruling board 101 in FIG. 12, to draw a center horizontal line 102 on board 101 in FIG. 12 with ruler 40 horizontal above pins 54 and 55**.

The absolute size of the board given, the size and positions of the pins given and the width of the ruler given determine the ultimate positions of location indicia 20–34 inclusive. The indicia are sized (spaced) for the board sizes stated as seen in use in the drawings.

In practice with respect to ruling lines and mark they are first made in non-reproducing blue lines. All inking is then performed. Thereafter the periphery is cleaned up.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. Apparatus for pre-ruling artists' and printing boards, comprising, in combination:

a flat, rectangular baseboard having a horizontal length greater than 20 inches and a vertical depth greater than 15 inches, one working face of the baseboard having location indicia marked thereon for placing artists' and printing boards of certain sizes in alignment on that surface for keyline marking and, as well, a plurality of location pins fixed to the said baseboard working face around the periphery thereof and extending at substantial right angles thereto, the working face of the board having upper and lower and right and left edges as faced by the operator, the upper and lower edges being horizontal and the right and left edges being vertical to the operator, an elongate ruler of length greater than 20 inches, having, on one edge thereof, at least three spaced sets of slots therein, each set being two slots positioned adjacent one another, one of the said slots being of a lesser and the other of a greater depth in the edge of the ruler, four of said location pins located one closely adjacent each corner of the baseboard in a rectangular array for use in connection with said ruler at least for drawing the work area margin lines, bleed area lines and register marks for an 11 by 17 inch size work area on an artists' or printing board, the opposed corner pins being vertically over 15 inches apart and horizontally over 20 inches apart, a first pair of outer pins, one positioned adjacent each baseboard vertical edge and somewhat below center thereof, for ruling the horizontal register marks, horizontally halving work areas of 11 by 17 inch size and vertically halving an 8½ by 5½ inch format, a second pair of outer pins, one positioned adjacent each baseboard horizontal edge and somewhat to right of center thereof for vertically halving 11 by 17 inch work areas and ruling vertical center register marks, a third pair of outer pins, one positioned adjacent each baseboard horizontal edge and somewhat left of center thereof for providing 11 by 17 inch work area page center mark measurements for the right hand page of 11 by 17 inch work areas, a fourth pair of outer pins, are positioned adjacent each baseboard horizontal edge and to right of the center thereof and to the right of the second pair of outer pins for providing page center mark measurements for the right hand page of an 11 by 17 inch work area, the outermost two sets of slots on the ruler so spaced as to be able to simultaneously engage the two upper or lower horizontal corner pins in like depth slots, one adjacent set of slots on the ruler, with one of said adjacent sets being an end set on the ruler, so spaced as to be able to simultaneously engage the two right or left vertical corner pins in like depth slots, and the first, second, third and fourth pairs of outer pins being positioned outboard of the corner pins on the baseboard.

2. Apparatus as in claim 1 wherein the elongate rectangular ruler has, on the said one edge thereof, four spaced sets of slots therein, the alternate sets of slots on the ruler, with one of said alternate sets being an end set on the ruler, so spaced as to be able to simultaneously engage the two right or left vertical pins in like depth slots.

3. Apparatus as in claim 1 wherein the baseboard has a horizontal length of approximately 24 inches and a vertical depth of approximately 18 inches, the elongate ruler having a length greater than the horizontal length of the baseboard and the slots in each set of the slots in the edge of the ruler being substantially ⅛ inch and ½ inch in dpeth, respectively.

4. Apparatus as in claim 1 wherein the base board has a horizontal length less than 24 inches and a vertical depth less than 18 inches, the elongate ruler of a length substantially that, at least, of the horizontal length of the board, the individual slots in the slot sets in the edge of the ruler having respective depths of substantially ⅛ inch and ½ inch.

5. Apparatus for pre-ruling artists' and printing boards, comprising, in combination:

a flat, rectangular baseboard having a horizontal length greater than 20 inches and a vertical depth greater than 15 inches, one working face of the baseboard having location indicia marked thereon for placing artists' and printing boards of certain sizes in alignment on that surface for keyline marking and, as well, a plurality of location pins fixed to the said baseboard working face around the periphery thereof and extending at substantial right angles thereto, the working face of the board having upper and lower and right and left edges as faced by the operator, the upper and lower edges being horizontal and the right and left edges being vertical to the operator, an elongate ruler of length greater than 20 inches, having, on one edge thereof, at least three spaced sets of slots therein, each said set comprising two slots positioned adjacent one another, one of the said slots being of a lesser and the other of a greater depth in the edge of the ruler, four of said location pins located one closely adjacent each corner of the baseboard in a rectangular array for use in connection with the said ruler at least for drawing the work area margin lines, and bleed area lines for an 11 by 17 size work area on an artists' or printing board, the opposed corner pins being vertically over 15 inches apart and horizontally over 20 inches apart, the outermost two sets of slots on the ruler so spaced as to be able to simultaneously engage the two upper or lower horizontal corner pins in like depth slots, and one adjacent set of slots on the ruler, with one of said adjacent sets being an end set on the ruler, so spaced as to be able to simultaneously engage the two right or left vertical corner pins in like depth slots.

6. Apparatus as in claim 5 including a first pair of outer pins, one positioned adjacent each baseboard vertical edge and somewhat below center thereof, for ruling the horizontal register marks, horizontally halving work areas of 11 by 17 inch size and vertically halving an 8½ by 5½ inch format, the said first pair of outer pins being positioned outboard of the corner pins on the baseboard.

7. Apparatus as in claim 6 including a second pair of outer pins, one positioned adjacent each baseboard horizontal edge and somewhat to right of center thereof for vertically halving 11 by 17 inch work areas and ruling vertical center register marks, the second pair of outer pins being positioned outboard of the corner pins on the baseboard.

8. Apparatus as in claim 5 including a first pair of outer pins, one positioned adjacent each baseboard vertical edge and somewhat below center thereof, for ruling the horizontal register mark, horizontally halving work areas of 11 by 17 inch size and vertically halving an 8½ by 5½ inch format, and a second pair of outer pins, one positioned adjacent each baseboard horizontal edge and somewhat to right of center thereof for vertically halving 11 by 17 inch work areas and ruling vertical center register marks, the first and second pairs of outer pins being positioned outboard of the corner pins on the baseboard.

9. Apparatus as in claim 8 including a third pair of outer pins, one positioned adjacent each baseboard horizontal edge and somewhat to left of center thereof for providing 11 by 17 inch work area page center mark measurements on the left hand page of such work area, and a fourth pair of outer pins, one positioned adjacent each baseboard horizontal edge and to right of center thereof and to the right of the second pair of outer pins for providing page center mark measurements for the right hand page of a 11 by 17 inch work areas, the third and fourth pairs of outer pins being positioned outboard of the corner pins on the baseboard.

* * * * *